US007448426B2

(12) United States Patent
Hsieh

(10) Patent No.: US 7,448,426 B2
(45) Date of Patent: Nov. 11, 2008

(54) FAILSAFE DOOR CLOSING DEVICE OF A FIRE PROOF ROLLING DOOR

(76) Inventor: Chung-Hsien Hsieh, No. 25-1, Fen-Liao Road, Lin-Kou Hsiang, Taipei Hsien (TW)

( * ) Notice: Subject to any disclaimer, the term of this patent is extended or adjusted under 35 U.S.C. 154(b) by 788 days.

(21) Appl. No.: 10/998,373

(22) Filed: Nov. 29, 2004

(65) Prior Publication Data

US 2006/0124249 A1 Jun. 15, 2006

(51) Int. Cl.
*E04F 15/20* (2006.01)

(52) U.S. Cl. ..... 160/7; 160/9; 160/310

(58) Field of Classification Search ..... 160/1, 160/7–9, 188, 189, 310, 311; 188/163
See application file for complete search history.

(56) References Cited

U.S. PATENT DOCUMENTS 5,203,392 A 4/1993 Shea
5,245,879 A 9/1993 McKeon
5,386,891 A 2/1995 Shea
5,850,865 A 12/1998 Hsieh
5,893,234 A * 4/1999 McKeon ..... 49/30
6,014,307 A * 1/2000 Crimmins ..... 361/170

* cited by examiner

*Primary Examiner*—Blair M. Johnson
(74) *Attorney, Agent, or Firm*—Bucknam & Archer

(57) ABSTRACT

A power-off door closing device of fire proof rolling door in which the rolling door slides down to close by its own weight under abnormal power-off condition by brake-releasing action or by brake-applied action of a braking pin actuated by a energized solenoid, through successive movement of the first end of a sliding lever of a solenoid with a bent arm, a clamp member and a brake actuating rod. This device can be easily changed into non-failsafe door closing fire proof type with original configurations wherein the solenoid is reverse located so that the brake-released action caused by an energized solenoid or the brake-applied action under abnormal power-off condition applies. A reserved power supply temporarily energizes the solenoid to maintain a temporary brake-releasing under abnormal power-off condition, to enable the rolling door sliding down to close by its own weight.

8 Claims, 6 Drawing Sheets

FAILSAFE DOOR CLOSING DEVICE OF A FIRE PROOF ROLLING DOOR

FIELD OF THE INVENTION

This invention relates to a power-off door closing device of fire proof rolling door, particularly to a fire proof rolling door which can be changed to a failsafe door closing type or non-failsafe door closing type with the same common control members.

DESCRIPTION OF PRIOR ART

There are two type of brake systems concerning conventional rolling door for fire proof purpose, one of them being failsafe door closing type in which the fire proof rolling door is immediately closed under power-off condition no matter how power-off happens, the other being non-failsafe door closing type in which the fire proof rolling door is not immediately closed under power-off condition no matter how power-off happens. A fire proof rolling door is ordinarily used as a door for coming in-and-out. The advantages and disadvantages of each type of brake systems will be described respectively as follow.

A) Failsafe Type

The fire proof rolling door of this type is immediately closed under power-off condition no matter how power-off happens. If power is still on under fire alarm condition, a smoke detector, temperature sensor, fire detecting device or fusible links which will be molt down by the heat caused by fire can also use to release the brake, to cause the rolling door sliding down by its own weight and close the door. If power-off is due to fire, the fire tongue or heavy smoke can be prevented from extending outside at first instance of fire disaster. Therefore, better safety for fire proof is the main advantage of this type. However, most of power-off in suburb area is not caused by fire. Door closing due to power-off under non-fire condition will cause inconvenience of users. This is the main disadvantage of this type. FIG. 6 is a schematic view showing a typical failsafe type fire proof rolling door cited in U.S. Pat. No. 5,245,879, which discloses a fire proof door having automatic break-down prevention facility. Brake actuation means, in general condition, uses potential energy of a spring to release brake, and uses a energized solenoid to resist potential energy of the spring, so as to move brake actuation means and engage the brake. In abnormal power-off condition, the solenoid is de-energized immediately so that the brake actuation means is activated by the spring to release brake, to cause the rolling door sliding down by its own weight to close. In addition, FIG. 7 is a schematic view showing another type failsafe type fire proof rolling door cited in U.S. Pat. No. 5,850,865, in which the brake under abnormal power-off condition is automatically released after a period of delay to cause the rolling door sliding down by its own weight to close.

B) Non-Failsafe Type

Under power-off condition, this non-failsafe type device is bringing into braking state and the fire proof rolling door is not immediately closed, unless a fire is detected and confirmed by a smoke detector, a temperature sensor or another fire detecting device to temporarily supply electric current to a solenoid by a reserved power source, such as capacitor or battery etc. to maintain a temporary brake-releasing, or a fusible links device is melted down by the high temperature caused by fire to mechanically release the brake, to cause the rolling door sliding down by its own weight to close. The main advantage of this type is that it will not close the fire proof rolling door immediately under power-off condition and it will not cause user's inconvenience if the power-off is not due to fire. However, if power-off is due to fire and fire ignition point is far away from the fire detecting device or the fusible links device, the fire proof rolling door can not be closed at the first instance of fire alarm. Therefore, insufficiency in safety is the main disadvantage of this type. FIG. 8 shows a non-failsafe type fire proof rolling door cited in U.S. Pat. No. 5,203,392, while FIG. 9 shows another cited in U.S. Pat. No. 5,386,891. Both publications have substantially the same power-off door closing mechanism. Under power-on condition, this door closing mechanism releases the brake by a solenoid to resist the potential energy of the spring. Under power-off condition, the door closing mechanism is acted by the spring to be brought into braking state. If power-off is due to fire, the brake is released by the melting down of temperature-sensitive fusible links by the high temperature caused by fire and through a push-rod stored with spring potential energy or through a chain.

Based on the description above, manufacturers have to produce two different control type in response to different users, for both failsafe door closing type and non-failsafe door closing type. Not only the time for development is long and cost is high, but also the parts numbers is high so that the production becomes complicated and the inventory is also high.

SUMMARY OF THE INVENTION

The object of this invention is to provide a power-off door closing device of a fire proof rolling door which can be changed easily into failsafe door closing type or non-failsafe door closing type by common structure members.

Above and the other objects can be attained by the power-off door closing device of fire proof rolling door of present invention, which is provided on one side face of the cover plate of the rolling machine for rotating the rolling door, a receiving chamber being formed on this side face by a tail cover; an inherent brake device being fixed on the other side face of said cover plate, a braking pin included in this brake device being extended into said receiving chamber, wherein it comprises: a brake actuation rod, one end of which being fixed on said brake actuation rod, the other end being formed as a free end; a clamp member, one end of which guides a sliding block, the other end being formed as a pivot end wherein one end of said sliding block abuts against the free end of said brake actuation rod, and the other end being a connecting end; a bent arm having a first end and a second end, said first end being supported on the pivot end of said clamp member and said first end including an extension end which moves together with the second end of the bent arm by a support arm; a solenoid having a sliding lever provided at the center and stored with potential energy of a spring, said sliding lever having a first end and a second end in which said first end moves together with the second end of the bent arm, and said first end being acted by the spring to be pushed outwardly in axial direction under de-energizing condition of said solenoid; a control circuit used to control the solenoid for brake-applying under energized condition of said solenoid or for brake-releasing under power-off condition. Thus, the brake under power-off condition is brought into released state to cause the rolling door sliding down to close by its own weight, no matter what is the cause of power-off. If power is still on under fire alarm condition, the power supply is cut either by a smoke detector, temperature sensor or another fire detecting device, or by the melting down of a conventional fusible links by the high temperature caused by fire to cut the power supply mechanically, so that the brake is released to cause the rolling door sliding down by its own weight to close. This is so-called failsafe door closing type.

According to present invention, it is easy to change into a non-failsafe door closing type with the original structure members without increasing additional cost. In other words, the solenoid is disposed in reverse orientation. The second end of said sliding lever, under the action of the solenoid in energized condition controlled by said control circuit, through the moving together of the second end of the sliding block and the second end of the bent arm, is pushed outwardly in axial direction to resist the potential energy of the spring so that the brake is brought into released state. Under power-off condition, said sliding lever is acted by the spring and the second end of it is retracted inwardly so as to bringing the device into braking state. At this moment, if fire is detected and confirmed by a smoke detector, a temperature sensor or another fire detecting device, electric current is temporarily supplied to the solenoid by a reserved power source, such as a capacitor or a battery etc. to maintain a temporary brake-releasing, or a fusible links device is melted down by the high temperature caused by fire to mechanically release the brake, to cause the rolling door sliding down by its own weight to close. In this way, not only that the development cost is low, parts numbers being few to make production simple and reduce inventories, but also the assembly is easy etc. This is another object of present invention.

According to present invention, it can reduce the force with the use of the clamp member and the bent arm. The device can be operated with a smaller solenoid. Therefore, cost-saving is still another object of present invention.

DETAILED DESCRIPTION OF A PREFERRED EMBODIMENT

The other technical features and advantages of present invention will be better understood by the detailed description of preferred embodiments of present invention, with reference to the accompanied drawings. However, it is noted that these embodiments are for illustrative purpose only, not for limitative purpose.

Figure 1:
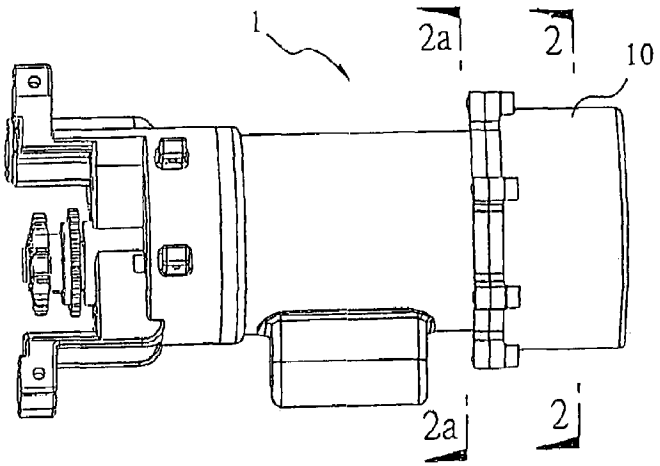
FIG. 1 is a side view showing the rolling machine of present invention.
Figure 2:
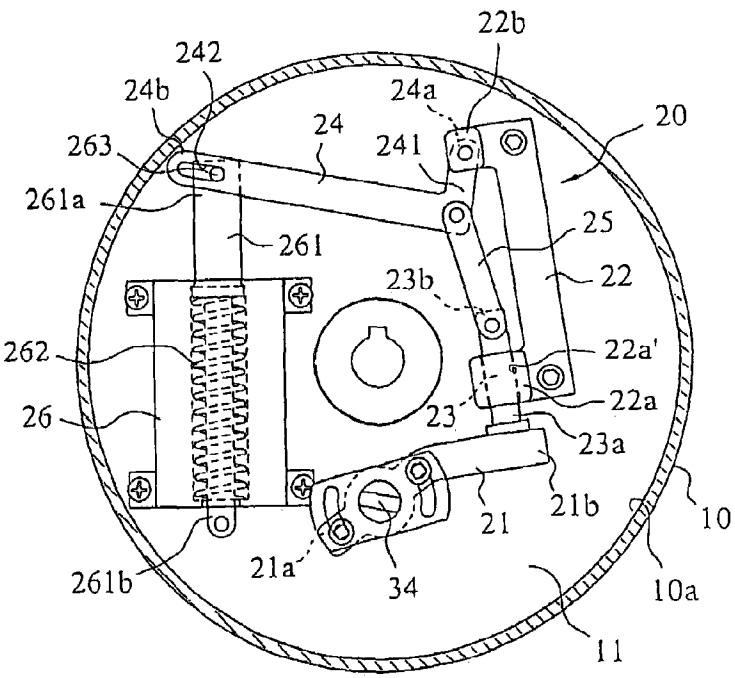
FIG. 2 is a sectional view taken along the line 2-2 in FIG. 1, wherein the power-off door closing device of present invention is brought into brake-releasing state.
Figure 2A:
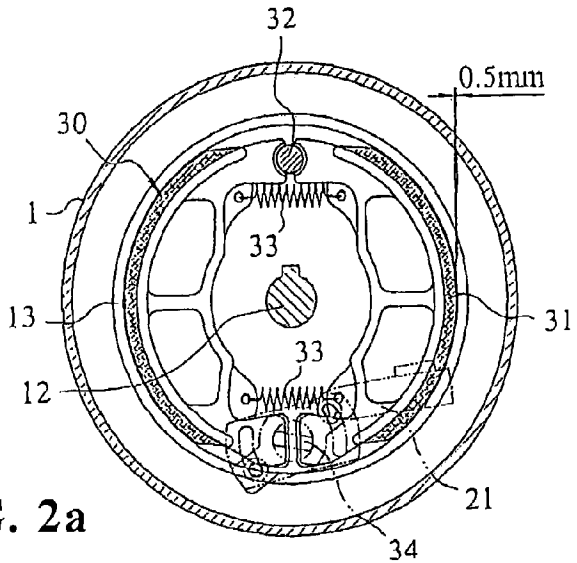
FIG. 2*a* is a sectional view taken along the line 2*a*-2*a* in FIG. 1, wherein the brake mechanism is brought into brake released state in response to the power-off door closing device of FIG. 2.

Referring to FIGS. 1, 2 and 2*a*, this invention includes a rolling machine 1 for rotating the rolling shaft of the rolling door. The tail end of the rolling machine 1 includes a cover plate 11. A receiving chamber 10*a* is formed by the tail cover 10 covered on the outside face of the cover plate 11 to form a receiving chamber 10*a*. The power-off door closing device 20 of fire proof rolling door of this invention is received within the receiving chamber 10*a* and fixed on one side face of the cover plate 11. A inherent brake device 30 comprises a pair of brake shoes 31 provided on the inside of the brake drum 13 which is fixed on the rotary shaft 12 of the rolling machine 1. One end of said pair of brake shoes 31 is pivoted on the other side face of said cover plate 11 through a shaft pin 32. The potential energy of a plurality of springs 33 oriented in radial direction is stored inside of said pair of brake shoes 31. A gap is formed between said brake drum 13 and said pair of brake shoes 31. The other ends of said pair of brake shoes 31 move together with one end of a braking pin 34 and rotate in clockwise direction, so that said pair of brake shoes 31 can expand outwardly in radial direction to rub against the brake drum 13 to brake. The other end of the braking pin 34 is extended and provided within the receiving chamber 10*a*.

According to this invention, a brake actuating rod 21 is included, one end of which is fixed on the braking pin 34 and the other end being formed as a free end 21*b*. Protruding portions 22*a*, 22*b* are formed respectively at opposite ends of a clamp member 22. Protruding portion 22*a* of one end has a guide groove 22*a*' for the guiding of a sliding block 23, while the protruding portion 22*b* of the other end forms a pivot end. One end 23*a* of the sliding block 23 is located at a position to abut with the free end 21*b* of the brake actuation rod 21, the other end of the sliding block 23 being a connecting end 23*b*. A bent arm 24 has a first end 24*a* and a second end 24*b* wherein the first end 24*a* is supported on the pivot end of the protruding portion 22*b* of the clamp member 22 and has an extension end 241 which moves together with the connecting end 23*b* by an support arm 25. A sliding groove 242 is formed on the second end 24*b*. A solenoid 26 is provided with a sliding lever 261 at its center, which has a first end 261*a* and a second end 261*b*. The sliding lever 261 is stored with potential energy of a spring 262 such that the first end 261*a* is pushed outwardly in axial direction under de-energized condition of the coil. A protruding pin 263 is provided on the first end 261*a* of the sliding lever 261, which is inserted and sliding in the sliding groove 242 of the second end 24*b* of the bent arm 24. A conventional control circuit (not shown) is used to control the rolling machine 1 to run/stop, at the same time to control the solenoid 26 for braking under energized condition of the coil or for brake releasing under power-off condition.

Figure 3A:
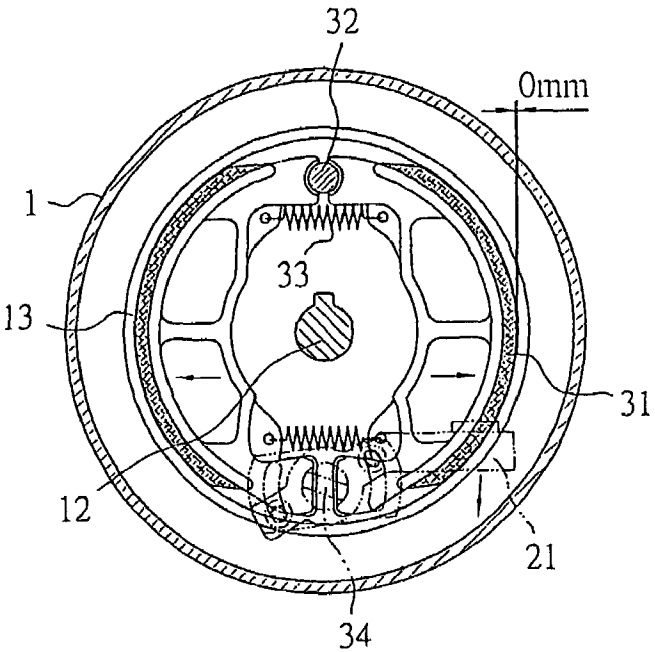
FIG. 3*a* shows that the brake mechanism is brought into brake-applied state in response to the power-off door closing device of FIG. 3.
Figure 3:
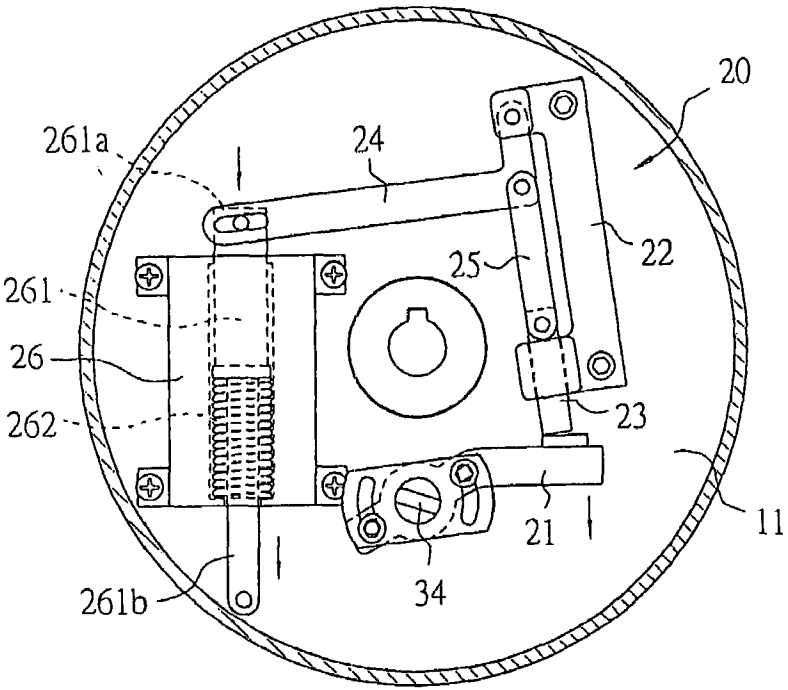
FIG. 3 shows that the power-off door closing device of FIG. 2 is brought into brake applied state.

As shown in FIGS. 3 and 3*a,* when the first end 261*a* of the sliding lever 261 resists the potential energy of the spring 262 under de-energizing condition of the coil of the solenoid 26 to retract inwardly in axial direction, the braking pin 34 is actuated through the successive movement of the bent arm 24, the arm 25, the clamp member 22, the sliding block 23 and the brake actuation rod 21, to rotate in clockwise direction to apply brake. Conversely, the sliding lever 261 under power-off condition is acted by the spring 262 to push the first end 261*a* outwardly in axial direction through the successive movement the bent arm 24, the arm 25, the clamp member 22, the sliding block 23 and the brake actuation rod 21, so that the braking pin 34 is released to return in counterclockwise direction to release the brake (as shown in FIG. 2 and 2*a*). Thus, the brake device 30, under power-off condition, is brought into released state to cause the rolling door sliding down to close by its own weight, no matter how power-off happens. If power is still on under fire alarm condition, the power supply is cut either by a smoke detector, temperature sensor or another fire detecting device, or by the melting down of a conventional fusible links by the high temperature caused by fire to cut the power supply mechanically (this portion belongs to conventional and is not shown), so that the brake is released to cause the rolling door sliding down by its own weight to close. This is so-called failsafe door closing type.

Figure 4A:
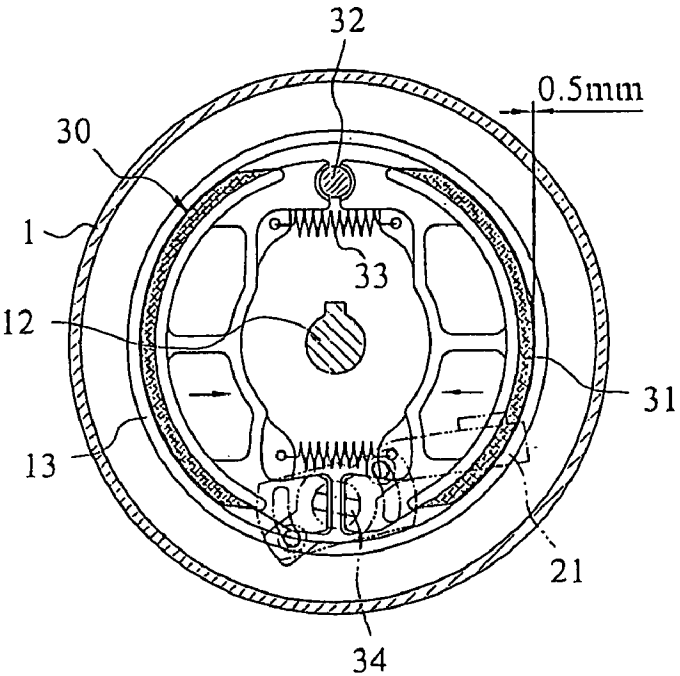
FIG. 4*a* shows that the brake mechanism is brought into brake-released state in response to the power-off door closing device of FIG. 4.
Figure 4:
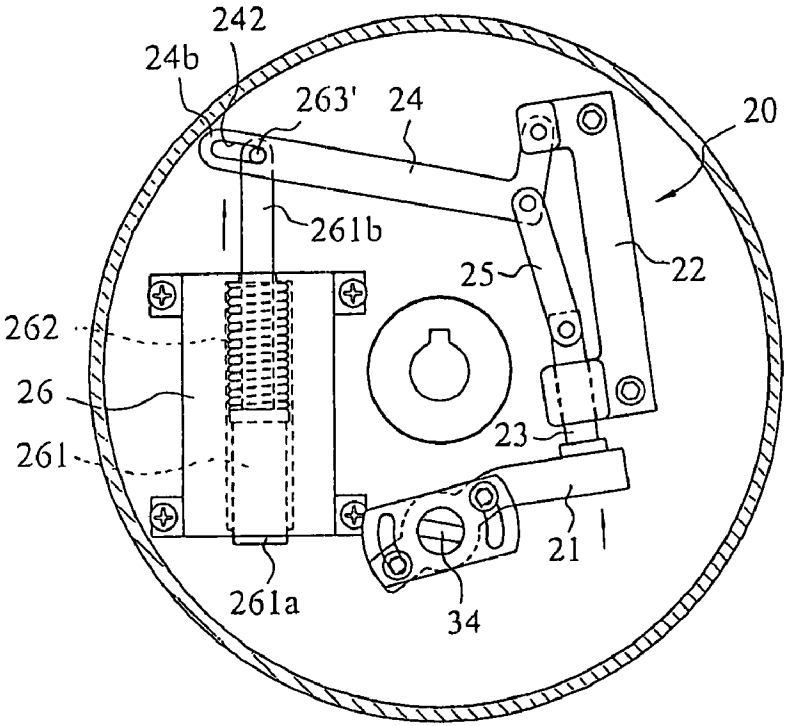
FIG. 4 is the second embodiment of the power-off door closing device of present invention, wherein said device is brought into brake released state.
Figure 5A:
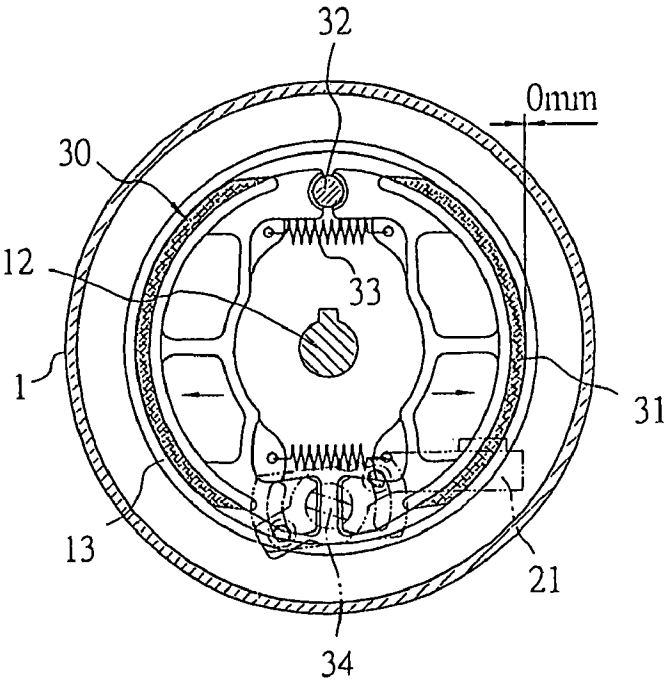
FIG. 5*a* shows that the brake mechanism is brought into brake-applied status in response to the power-off door closing device of FIG. 5.
Figure 5:
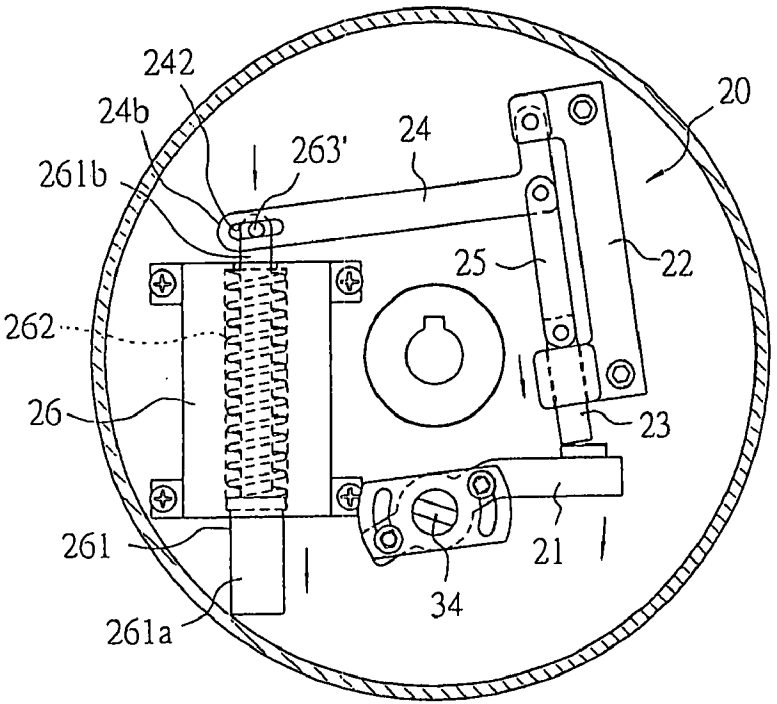
FIG. 5 shows that the power-off door closing device of FIG. 4 is brought into brake applied state.
Figure 7:
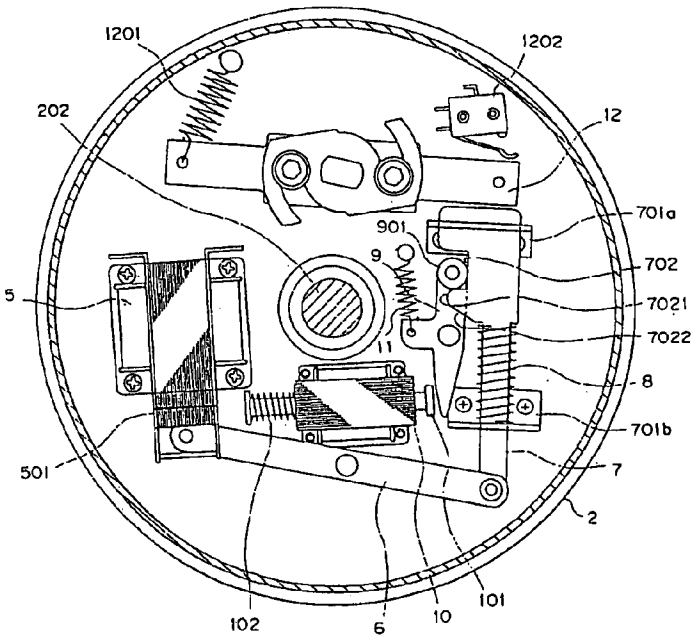
FIG. 7 (prior art)
FIG. 7 is a schematic view showing a conventional delayed door closing device of fire proof rolling door cited in U.S. Pat. No. 5,850,865.
Figure 6:
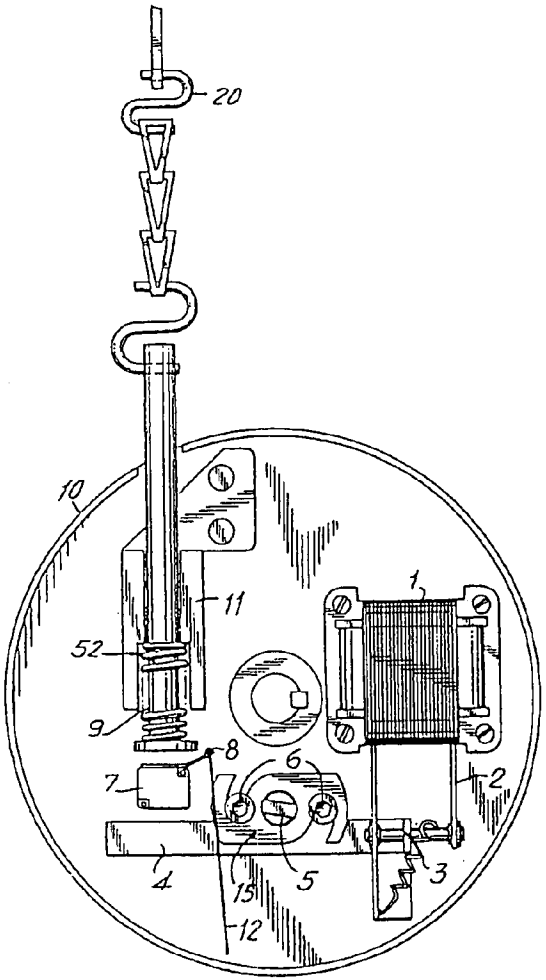
FIG. 6 (prior art)
FIG. 6 is a schematic view showing a conventional door closing device of fire proof rolling door cited in U.S. Pat. No. 5,245,879.
Figure 9:
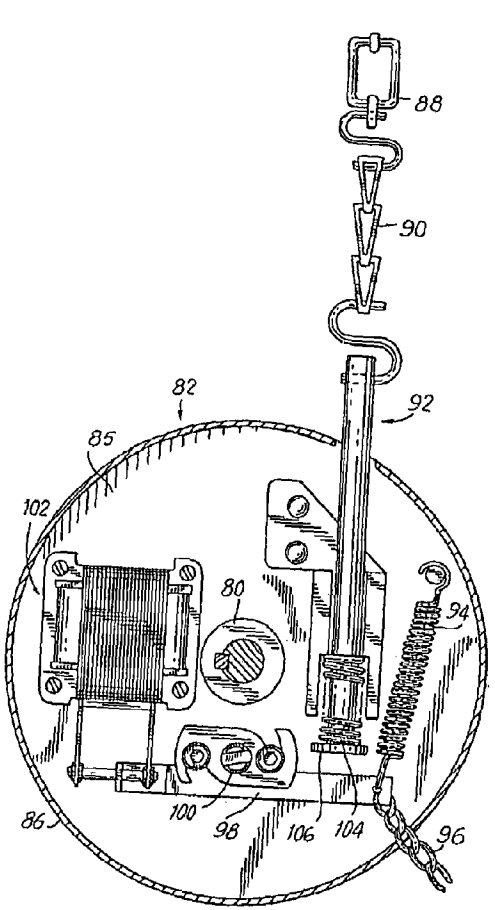
FIG. 9 (prior art)
FIG. 9 is a schematic view showing a conventional door closing device of fire proof rolling door cited in U.S. Pat. No. 5,386,891.
Figure 8:
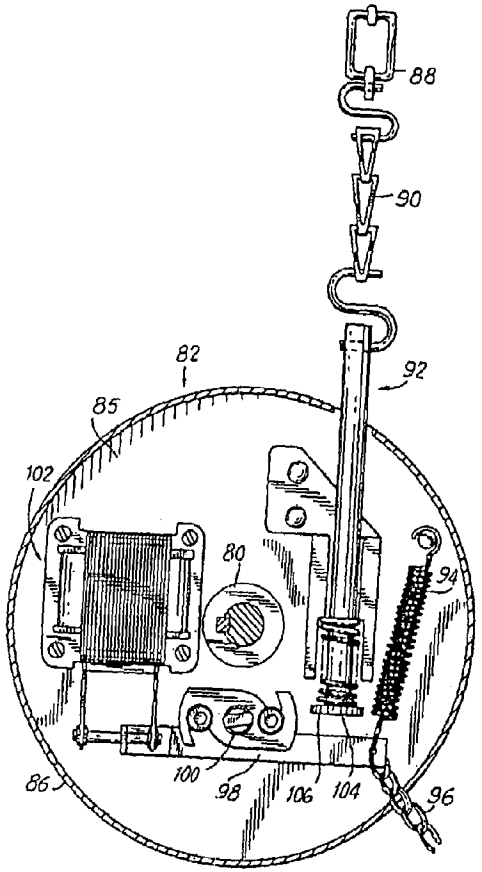
FIG. 8 (prior art)
FIG. 8 is a schematic view showing a conventional door closing device of fire proof rolling door cited in U.S. Pat. No. 5,203,392.

Referring further to FIG. 4 and 4*a,* it is easy to change into a non-failsafe door closing type with original structure members without increasing additional cost. In other words, the solenoid 26 is disposed in reverse orientation. A protruding pin 263' provided on the second end 261*b* of said sliding lever 261 is inserted into the sliding groove 242 on the second end 24*b* of the bent arm 24 and moving together with the bent arm 24. The rest of the structure remains unchanged. A conventional control circuit is used to control the rolling machine 1 to run/stop, at the same time to control the solenoid 26 to release brake under energized condition of the coil or to apply brake under power-off condition. As shown in FIG. 4 and 4*a,* when the second end 261*b* of said sliding lever 261, under the action of the solenoid 26 in energized condition of the coil, resists the potential energy of the spring 262 and is pushed outwardly in axial direction, the braking pin 34 is actuated through the successive movement of the bent arm 24, the arm 25, the clamp member 22, the sliding block 23 and the brake actuation rod 21, to rotate in counterclockwise direction to return so as to release the brake. Conversely, the sliding lever 261 under power-off condition is acted by the spring 262 to push the second end 261*b* retracting inwardly in axial direction through the successive movement the bent arm 24, the arm 25, the clamp member 22, the sliding block 23 and the brake actuation rod 21, so that the braking pin 34 is rotated to in clockwise direction to apply brake (as shown in FIG. 5 and 5*a*). Thus, the sliding lever 261, under power-off condition, is acted by the spring 262 to cause the second end 261*b* retracting inwardly in axial direction so as to bring the device into braking state. At this moment, if fire is detected and confirmed by a smoke detector, a temperature sensor or another fire detecting device, electric current is temporarily supplied to the solenoid 26 by a reserved power source, such as a capacitor or a battery etc. to maintain a temporary brake-releasing, or a fusible links device is melted down by the high temperature caused by fire, to push the sliding lever 261 in reverse direction mechanically (this portion is conventional and is not shown here.), to cause the rolling door sliding down by its own weight to close.

Summing up above, the power-off door closing device of fire proof rolling door of present invention has the advantages set forth below.

(1) since it is easy to change into failsafe door closing type or non-failsafe door closing type with the common structure members, the development cost can be reduced remarkably.

(2) The change between these two different door closing fire proof type is easily accomplished by the reverse change of solenoid orientation. In addition, installation can be simplified due to the reduction in parts numbers.

(3) The inventory can be reduced or simplified because the two different door closing fire proof types almost have the same common parts.

(4) The production can be simplified and economized because the two different door closing fire proof type almost have the same common parts.

(5) The structure of present invention can reduce the applying force with the use of the clamp member. Thus, this device can be operated with a smaller solenoid to become more economic in cost.

The above-mentioned are only preferred embodiments of the present invention which should not be considered to be a limitation on the range of the present invention. Any variations, modifications or equivalent changes without departing from the range or spirit of the appended claims of present invention should be considered to be within the range of present invention.

LIST OF REFERENCE NUMERALS

1 rolling machine
10 tail cover
10*a* receiving chamber
11 cover-plate
12 rotary shaft
13 brake drum
20 power-off door closing device of present invention
21 brake actuation rod
22 clamp member
23 sliding block
24 bent arm
241 extension end
242 sliding groove
25 support arm
26 solenoid
261 sliding lever
262 spring
263 protruding pin
30 brake device
31 brake shoe
32 shaft pin
33 spring
34 brake pin

What is claimed is:

1. A power-off door closing device 20 of a fire proof rolling door, which is provided on one side face of a cover plate 11 of a rolling machine 1 for rotating a rolling shaft, a receiving chamber 10*a* being formed on this side face by a tail cover 10; a brake device 30 being fixed on the other side face of said cover plate 11, a braking pin 34 included in the brake device 30 being extended into said receiving chamber 10*a*, wherein that said device comprises:

a brake actuation rod 21, one end 21*a* of which being fixed on said braking pin 34, the other end being formed as a free end 21*b;* a clamp member 22, one end 22*a* of which guides a sliding block 23, the other end being formed as a pivot end 22*b*, wherein one end 23*a* of said sliding block 23 abuts against the free end 21*b* of said brake actuation rod 21, and the other end being a connecting end 23*b;* a bent arm 24 having a first end 24*a* and a second end 24*b*, said first end 24*a* being supported on the pivot end 22*b* of said clamp member 22 and said first end 24*a* including an extension end 241 which moves together with the connecting end 23*b* of the sliding block 23 by a support arm 25 connected between said bent arm (24) and said connecting end (23*b*);

a solenoid 26, having a sliding lever 261 provided at the center thereof and stored with potential energy of a spring 262, said sliding lever 261 having a first end 261*a* and a second end 261*b* in which said first end 261*a* moves together with the second end 24*b* of the bent arm 24, and said first end 261*a* being acted by the spring 262 to be pushed outwardly in axial direction under de-energized condition of said solenoid;

a control circuit used to control the solenoid 26 for brake-applying under energized condition or for brake- releasing under power-off condition, thus, said brake is brought into released state under abnormal power-off condition to cause the rolling door sliding down by its own weight to close.

2. A power-off door closing device 20 of fire proof rolling door as claimed in claim 1, wherein a sliding groove 242 is formed on the second end 24*b* of said bent arm 24, a protruding pin 263 fixed on the first end 261*a* of the sliding lever 261 of said solenoid 26 being inserted into and sliding in said sliding groove 242.

3. A power-off door closing device 20 of a fire proof rolling door, which is provided on one side face of a cover plate 11 of a rolling machine 1 for rotating a rolling shaft, a receiving chamber l0*a* being formed on this side face by a tail cover 10; a brake device 30 being fixed on the other side face of said cover plate 11, a braking pin 34 included in the brake device 30 being extended into said receiving chamber l0*a*, characterized in that said device comprises:

a brake actuation rod 21, one end 21*a* of which being fixed on said braking pin 34, the other end being formed as a free end 21*b;* a clamp member 22, one end 22*a* of which guides a sliding block 23, the other end being formed as a pivot end 22*b*, wherein one end 23*a* of said sliding block 23 abuts against the free end 21*b* of said brake actuation rod 21, and the other end being a connecting end 23*b;* a bent arm 24 having a first end 24*a* and a second end 24*b* , said first end 24*a* being supported on the pivot end 22*b* of said clamp member 22, and said first end 24*a* including an extension end 241 which moves together with the connecting end 23*b* of the sliding block 23 by a support arm 25 connected between said bent arm (24) and said connecting end (23*b* );

a solenoid 26 , having a sliding lever 261 provided at the center thereof and stored with potential energy of a spring 262, said sliding lever 261 having a first end 261*a* and a second end 261*b* in which said first end 261*a* moves together with the second end 24*b* of the bent arm 24, and said second end 261*b* resisting the potential energy of the spring 262 to be pushed outwardly in axial direction under energized condition of said solenoid;

a control circuit used to control the solenoid 26 for brake-releasing under energized condition or for brake-applying under power-off condition, thus, said brake is brought into brake applied state under abnormal power-off condition, if fire is detected and confirmed by a fire detection device, electric current being supplied temporarily to the solenoid from a reserved power supply to maintain a temporary brake releasing so as to cause the rolling door sliding down by its own weight to close.

4. A power-off door closing device 20 of fire proof rolling door as claimed in claim 3, wherein a sliding groove 242 is formed on the second end 24*b* of said bent arm 24, and a protruding pin 263' fixed on the second end 261*b* of the sliding lever 261 of said solenoid 26 is inserted and sliding within said sliding groove 242.

5. A power-off door closing device 20 of fire proof rolling door as claimed in claim 3, wherein said reserved power supply is a capacitor contained within said control circuit.

6. A power-off door closing device 20 of fire proof rolling door as claimed in claim 3, wherein said reserved power supply is a battery contained within said control circuit.

7. A power-off door closing device 20 of fire proof rolling door as claimed in claim 3, wherein said fire detection device is a smoke detector.

8. A power-off door closing device 20 of fire proof rolling door as claimed in claim 3, wherein said fire detection device is a temperature sensor.

* * * * *